US005208104A

United States Patent [19]

Ueda et al.

[11] Patent Number: 5,208,104

[45] Date of Patent: May 4, 1993

[54] HIGH-TENACITY WATER-SOLUBLE POLYVINYL ALCOHOL FIBER AND PROCESS FOR PRODUCING THE SAME

[75] Inventors: Fujio Ueda; Hiroyoshi Tanaka, both of Ehime; Masahiko Hayashi, Iyo, all of Japan

[73] Assignee: Toray Industries, Inc., Tokyo, Japan

[21] Appl. No.: 729,890

[22] Filed: Jul. 11, 1991

Related U.S. Application Data

[63] Continuation of Ser. No. 279,172, Dec. 2, 1988, abandoned.

[30] Foreign Application Priority Data

Feb. 10, 1988 [JP] Japan ..... 63-29563

[51] Int. Cl.[5] ..... D02G 3/00

[52] U.S. Cl. ..... 428/364; 428/397

[58] Field of Search ..... 428/364, 397

[56] References Cited

U.S. PATENT DOCUMENTS

| | | | |
|---|---|---|---|
| 3,915,750 | 10/1975 | Uetani et al. | 429/173 |
| 3,987,140 | 10/1976 | Mizobe et al. | 264/185 X |
| 4,478,971 | 10/1984 | Ballard | 264/185 X |
| 4,603,083 | 7/1986 | Tanaka et al. | 428/364 |
| 4,713,290 | 12/1987 | Kwon | 428/364 |

*Primary Examiner*—Patrick J. Ryan
*Assistant Examiner*—N. Edwards
*Attorney, Agent, or Firm*—Armstrong, Westerman, Hattori, McLeland & Naughton

[57] ABSTRACT

A high-tenacity water-soluble polyvinyl alcohol fiber comprising a fiber composed of a polyvinyl alcohol polymer with a degree of polymerization of at least 1500 and a degree of saponification of 80 to 99 mol % and having a tensile strength of at least 10 g/d, an initial modulus of at least 100 g/d, and a water soluble temperature of 100° C. or below, and a process of producing the fiber.

5 Claims, 3 Drawing Sheets

HIGH-TENACITY WATER-SOLUBLE POLYVINYL ALCOHOL FIBER AND PROCESS FOR PRODUCING THE SAME

This application is a continuation of application Ser. No. 279,172 filed Dec. 2, 1988 is now abandoned.

BACKGROUND OF THE INVENTION

The present invention relates to a high-tenacity water-soluble polyvinyl alcohol (hereinafter abbreviated to "PVA") fiber and a process for producing the same. More particularly, this invention is concerned with a novel water-soluble PVA fiber not only having excellent mechanical properties comparable to those of an aramid fiber but also exhibiting very high dissolving shrinkage ratio and dissolving shrinkage stress, as opposed to the conventional water-soluble PVA fiber.

Examples of the water-soluble fibers well known to the art which is soluble in hot water or water of room temperature include a PVA fiber, an alginate fiber, a cellulose fiber, and a polyethylene oxide fiber. However, among them, only PVA fiber can meet the requirements with respect to the mechanical properties for further processing such as spinning and knitting and weaving, while the other fibers cannot meet the requirements with respect to the mechanical properties. Examples of the process for producing the above-described PVA fiber include one wherein an aqueous high concentration solution of PVA having a degree of saponification as low as 99 mol % is dry-spun (Japanese Patent Publication No. 892/1968) and one wherein the acetalization is not conducted after wet-spinning of an aqueous solution of completely saponified PVA having a degree of saponification of 99 mol % into a saturated aqueous solution of Glauber's salt.

However, the tensile strength and the initial modulus of the water-soluble PVA fibers prepared by the above-described processes are as low as about 3 to 4 g/d and about 50 to 60 g/d, respectively. Although the dissolution of the above-described fibers in water is accompanied with shrinkage, the maximum dissolving shrinkage ratio and the maximum dissolving shrinkage stress are as low as about 50% and about 200 mg/d, respectively. For this reason, the above-described fibers have been used only for special applications such as backing fabrics for chemical laces and raveling cords for socks, and it has been impossible to find applications in the industries where high mechanical properties are required.

In recent years, industrial materials which maintain the shape with predetermined mechanical properties for a given period but disappear through self-disintegration after passage of the given period have been desired in the art. That is, underwater disintegrable high tenacity fiber materials and high tenacity ropes have been desired in the art.

However, it was quite impossible to apply the above-described conventional fibers to these special applications.

SUMMARY OF THE INVENTION

An object of the present invention is to provide a water-soluble PVA fiber having mechanical properties, such as tenacity and initial modulus, superior to those of the conventional water-soluble PVA fiber and suitable particularly for industrial applications.

Another object of the present invention is to provide a water-soluble fiber which is very high in the mechanical properties as well as in the dissolving shrinkage ratio and the dissolving shrinkage stress.

A further object of the present invention is to provide a process for preparing the above-described water-soluble PVA fiber having excellent mechanical properties etc.

The high-tenacity water-soluble polyvinyl alcohol fiber of the present invention which can attain the above-described objects is characterized by comprising a polyvinyl alcohol polymer with a degree of polymerization of at least 1500 and a degree of saponification of 80 to 99 mol % and by having a tensile strength of at least 10 g/d, an initial modulus of at least 100 g/d, and a water soluble temperature of 100° C. or below. Further, the high-tenacity water-soluble polyvinyl alcohol fiber of the present invention is characterized by having a maximum dissolving shrinkage ratio of at least 60% and a maximum dissolving shrinkage stress of at least 300 mg/d.

The above-described high-tenacity water-soluble polyvinyl alcohol fiber of the present invention can be prepared by a process comprising:

- dissolving a polyvinyl alcohol polymer having a degree of polymerization of at least 1500 and a degree of saponification of 80 to 99 mol % in a solvent;
- subjecting the resultant polymer solution to dry-jet wet spinning so that the residence time of the resultant coagulated filament in a coagulation bath is at least 5 sec or
- subjecting said resultant polymer solution to gel spinning so that the residence time of the resultant gelled filament in a cooling bath is at least 5 sec; and
- drawing the resultant coagulated filament or gelled filament at a final drawing temperature of 180 to 230° C. so that the total effective draw ratio is at least 10 times.

DETAILED DESCRIPTION OF THE INVENTION

Figure 1A:
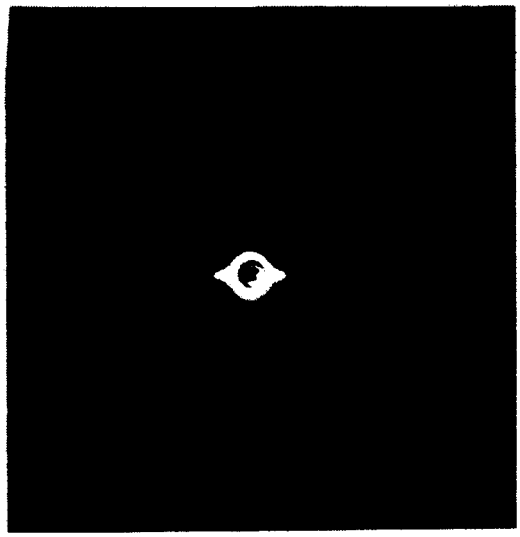
FIGS. 1(A), 1(B), and 1(C) are photographs of small-angle X-ray scattering pattern of the high-tenacity water-soluble PVA fiber obtained in Example 1 in FIG. 1A, Example 5 in FIG. 1B and Example 8 in FIG. 1C of this invention, respectively.
Figure 1B:
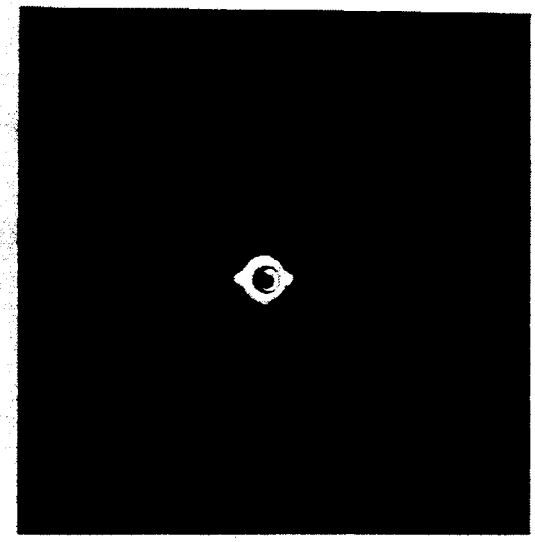
Figure 1C:
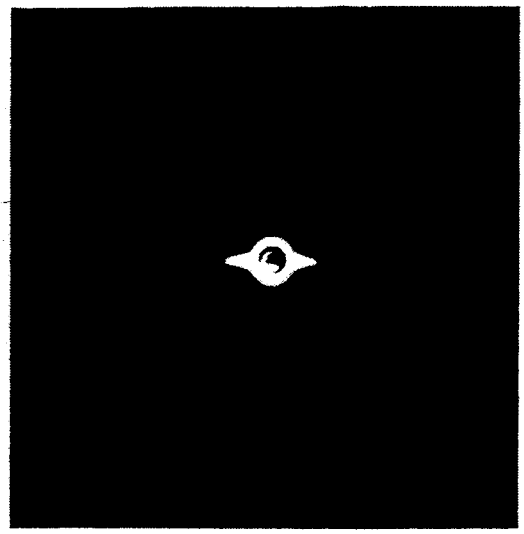
Figure 2:
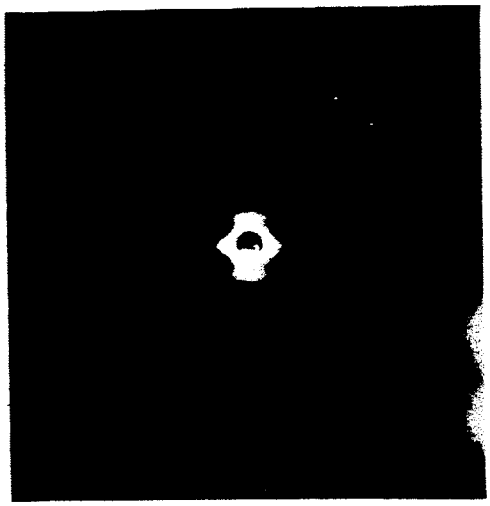
FIG. 2 is a photograph of small-angle X-ray scattering pattern of the conventional water soluble PVA fiber obtained in Comparative Example 5.

In the present invention, the degree of polymerization and degree of saponification with respect to PVA and the mechanical properties, water soluble temperature, maximum dissolving shrinkage ratio, and maximum dissolving shrinkage stress with respect to the fiber are defined (measured) as follows.

(a) Degree of Polymerization of PVA:

The degree of polymerization (Pn) was calculated from the intrinsic viscosity value [0]of PVA at 30° C. in the form of an aqueous solution according to JIS K 6726.

$$log(Pn) = 1.613 \times log([\eta] \times 10^4/8.29)$$

wherein $[\eta]$ is expressed in terms of ml/g.

(b) Degree of saponification of PVA:

The degree of saponification was calculated from the amount of the remaining acetate group determined by acidimetry according to JIS K6726.

(c) Mechanical properties of fiber (tensile strength and initial modulus):

The humidity of the fiber was previously regulated by allowing it to stand for 24 hr under conditions of a temperature of 20° C. and a relative humidity of 65%. A sample having a filament length of 20 mm was prepared from the fiber and subjected to the mechanical properties with a Tensilon tensile tester under a condition of a tensile rate of 100 mm/min.

(d) Water soluble temperature and maximum dissolving shrinkage ratio:

A fiber bundle was immersed in water of 10° C. in such a state that an initial load of 2 mg/d was applied thereto, and then the temperature of water was raised at a rate of 1° C./min. The water soluble temperature was determined as a temperature of water at breaking of the fiber, and the maximum dissolving shrinkage ratio was determined as a maximum ratio of the shrinkage caused until it brought about breaking.

(e) Maximum dissolving shrinkage stress:

A filament was mounted on a Tensilon tensile tester with a grasp distance of 20 mm in such a state that a tensile force of 5 mg/d was applied to the filament. Then, the fiber was immersed in water of 10° C., and the temperature of water was raised at a rate of 1° C./min while maintaining the grasp distance at a constant value to determine the relationship between the shrinkage stress and the water temperature. The maximum shrinkage stress experienced until the fiber was dissolved in water was regarded as the dissolving maximum shrinkage stress.

(f) Small-angle X-ray scattering:

It was measured under the following conditions according to the known method that employs a Kiesseg camera.

Apparatus: X-ray generator, Model Ru-200, manufactured by Rigaku Denki K. K.
Line: Cu Kα line (with Ni filter)
Output: 50 kV-150 mA
0.3 mm collimator: transmission method
Camera radius: about 400 mm
Exposure: 120 min
Film: Kodak DEF-5

The high-tenacity water-soluble PVA fiber of the present invention has very high mechanical properties and should have a tensile strength of at least 10 g/d, preferably at least 11 g/d, more preferably at least 12 g/d and an initial modulus of at least 100 g/d, preferably at least 150 g/d, more preferably at least 180 g/d, most preferably at least 200 g/d. When the water-soluble PVA fiber has a tensile strength of less than 10 g/d and an initial modulus of less than 100 g/d, it is unsatisfactory for use as a fiber particularly for marine materials, so that the applications thereof are also limited.

The water soluble temperature of the high-tenacity water-soluble PVA fiber of the present invention is 100° C. or below, preferably 95° C. or below, more preferably 80° C. or below, most preferably 70° C. or below. When the water soluble temperature exceeds 100° C., the fiber should be treated in pressurized boiling water for a long period of time for the purpose of dissolving the fiber, so that the applications of the fiber as a water-soluble one are very limited.

The high-tenacity water-soluble PVA fiber of the present invention has a maximum dissolving shrinkage ratio of at least 60%, preferably at least 65%, more preferably at least 70%, most preferably at least 75% and a maximum dissolving shrinkage stress of at least 300 mg/d, preferably at least 350 mg/d, more preferably at least 400 mg/d, most preferably at least 500 mg/d. When the maximum dissolving shrinkage ratio is lower than 60% or the maximum shrinkage stress is lower than 300 mg/d, the fiber cannot exhibit a sufficient effect when used for industrial applications, such as shrinkable binding cords and root winding materials for vegetables, where a large shrinkage stress is required.

The PVA fiber of this invention apparently differs in fiber structure from the conventional water-soluble PVA fiber. The difference is noticed in, for example, long-period pattern of the small angle X-ray scattering. Long-period pattern of the small angle X-ray scattering represents the order structure formed by the repeating crystalline phase and amorphous phase in the fiber. The PVA fiber of this invention has such a unique fiber structure that the long-period pattern of the small angle X-ray scattering is four point (FP).

As is apparent from the X-ray photographs in FIGS. 1(A), 1(B), and 1(C) and FIG. 2, the PVA fiber of this invention differs from the conventional one in that the long period pattern is detected as dash (DA).

Figure 3:
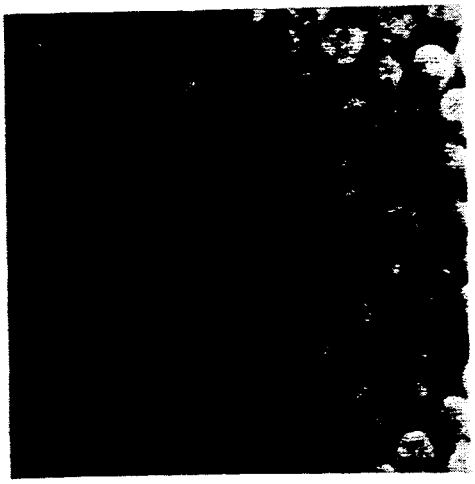
FIG. 3 is a photograph of cross-section of the high-tenacity water-soluble PVA fiber obtained in Example 1 of this invention.
Figure 4:
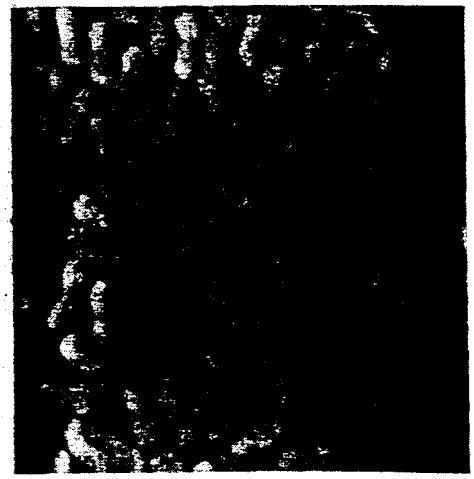
FIG. 4 is a photograph of cross-section of the conventional water-soluble PVA fiber obtained in Comparative Example 5.

Further, the PVA fiber of the present invention is characterized by having a round cross section shown in FIG. 3 as opposed to the conventional water soluble PVA fiber having a non-round cross section (cocoon-shape cross section) shown in FIG. 4.

The process for preparing the high-tenacity water-soluble PVA fiber according to the present invention will now be described.

The high-tenacity water-soluble PVA fiber according to the present invention can be prepared by subjecting a solution of a PVA polymer having a degree of polymerization of at least 1500, preferably at least 2000, more preferably at least 2500 and a degree of saponification of 80 to 99 mol %, preferably 85 to 98 mol %, more preferably 87 to 97 mol % to dry-jet wet spinning so that the residence time of the resultant coagulated filament in a coagulating bath is at least 5 sec and drawing the filament at a final drawing temperature of 180° to 230° C. so that the total effective draw ratio is at least 10 times. Alternatively, the high-tenacity water-soluble PVA fiber according to the present invention can be prepared by subjecting a solution of a PVA polymer of the kind as described above to gel spinning so that the residence time of the resultant gelled filament in a cooling bath is at least 5 sec and drawing the resultant coagulated filament or gelled filament at a final drawing temperature of 180° to 230° C. so that the total effective draw ratio is at least 10 times.

The term "total effective draw ratio" used herein is intended to mean a draw ratio based on the coagulated filament or gelled filament. In the process described above, when the degree of polymerization of the PVA polymer is lower than 1500, it is impossible to prepare a high-tenacity water-soluble PVA fiber of the present invention having mechanical properties of a tensile strength of at least 10 g/d and an initial modulus of at least 100 g/d and dissolving shrinkage characteristics of a maximum shrinkage ratio of at least 60% and a maximum shrinkage stress of at least 300 mg/d. When the degree of saponification of the PVA polymer exceeds 99 mol %, the water-insolubility is enhanced, which makes it impossible to attain one of the features of the PVA fiber of the present invention, i.e., dissolution of the fiber in water of 100° C. or below. On the other hand, when the degree of saponification is lower than 80 mol %, it becomes difficult not only to attain sufficient mechanical properties and thermal stability necessary for a fiber but also to prepare a fiber.

In the present invention, it is necessary that the above-described coagulated filament or gelled filament be drawn and oriented at a final drawing temperature of 180° to 230° C. to such a large extent that the total effective draw ratio is at least 10 times. When the draw ratio is less than 10 times, it is impossible to attain the mechanical properties and dissolving shrinkage characteristics necessary for the high-tenacity water-soluble PVA fiber of the present invention.

In order to enable the drawing of the filament to such a high extent that the above-described PVA polymer having a high degree of polymerization and a low degree of saponification is drawn and oriented to a large extent, it is important to properly select the spinning process. The spinning process is preferably dry-jet wet spinning and gel spinning, particularly preferably dry-jet spinning.

The term "dry-jet wet spinning" used in the present invention is intended to mean a spinning process which comprises extruding a spinning solution from a spinneret into an inert atmosphere, such as air, nitrogen, helium, or argon, and introducing the extruded filament in a coagulated bath to coagulate the filament.

Examples of the spinning solvent used in the dry-jet wet spinning include dimethyl sulfoxide (hereinafter abbreviated to DMSO), water, glycerin, ethylene glycol, diethylene glycol, triethylene glycol, a highly concentrated aqueous solution of sodium thiocyanate, and a mixed solvent comprising the above-described solvents. The spinning solvent is preferably DMSO, water, glycerin, and ethylene glycol, more preferably DMSO.

It is necessary that the degree of saponification of the above-described PVA polymer be maintained even when the PVA polymer is in the form of a fiber. For this reason, when a spinning solution is prepared, it is preferred to use such a solvent as will bring about no saponification reaction even when allowed to stand at a temperature of 80° C. or above for a long period of time (e.g., 6 hr or longer). Specific preferable examples of the solvent include DMSO which has been adjusted with an acid so that the hydrogen ion concentration (pH) at 25° C. is 6 to 8.

Since the PVA polymer having a low degree of saponification is water soluble, an alcohol, such as methanol, ethanol or butanol, an organic solvent such as acetone, benzene or toluene, and a mixed solvent comprising at least one of these solvents and the above-described spinning solvent is used as the coagulation bath for the above-described dry-jet wet spinning. The coagulation bath is preferably a mixed solvent comprising methanol and DMSO (in a methanol to DMSO mixing weight ratio of 100/0 to 80/20, preferably 100/0 to 85/15).

The term "gel spinning" used in the present invention is intended to mean a spinning process which comprises extruding a spinning solution from a spinneret into a small space of an inert atmosphere and leading the extruded filament to a cooling bath comprising a liquid immiscible with the solvent for the spinning solution, thereby allowing the extruded filament to cool and gel as it is without substantially causing a change in the polymer concentration of the extruded filament.

The solvent for the spinning solution used in the gel spinning is preferably one which brings about gellation when a solution prepared by heating and dissolution of a PVA polymer at a high temperature in the solvent is allowed to cool. Specific examples of the solvent include polyhydric alcohols such as glycerin, ethylene glycol, propylene glycol, diethylene glycol, triethylene glycol, tetraethylene glycol, and trimethylolpropane; and solvents which are nonvolatile at room temperature, such as benzenesulfonamide and caprolactam. It is preferred that the above-described solvent be selected from among glycerin and ethylene glycol.

Further, in the gel spinning process, since the PVA polymer having a low degree of saponification is poor in the thermal stability and decomposed at 190° to 230° C., the spinning solution is maintained at a temperature of 190° C. or below, preferably 180° C. or below.

The cooling bath used in the gel spinning is a liquid which is immiscible with the above-described solvent for the spinning solution and a non-solvent with respect to the PVA polymer. Preferable examples of the cooling bath include decalin, trichloroethylene, carbon tetrachloride, and paraffin oil.

In the above-described dry-jet wet spinning or gel spinning, the rate of coagulation or gellation of a solution the PVA polymer having a low degree of saponification is very low, which brings about sticking among filaments. In order to prevent the above-described sticking, it is preferred that the PVA polymer concentration of the spinning solution be adjusted to 12 to 30 wt %, preferably 15 to 25 wt %.

Further, in order to prevent the sticking among filaments, it is preferred that the residence time of the coagulated filament in the coagulation bath or the gelled filament in the cooling bath be at least 5 sec, preferably at least 10 sec. When the residence time is shorter than 5 sec, the drawability is lowered because the filaments are stuck to each other and the coagulation or gellation is insufficient.

Furthermore, in order to prevent the above-described sticking, it is preferred that the undrawn filament comprising the coagulated filament or the gelled filament be dried at a temperature of 70° C. or below, preferably 60° C. or below. Further, it is also preferable that a fluorine or silicone lubricant for prevention of sticking is applied to the undrawn filament prior to hot drawing.

In the present invention, it is necessary that the coagulated filament or the gelled filament thus prepared be drawn to such a large extent that the total effective draw ratio is at least 10 times. It is noted in this connection that the drawing temperature should be 180° to 230° C., preferably 190° to 225° C. The heating means is preferably a hot-air heating tube or a hot plate. Although the total effective draw ratio should be at least 10 times, it is preferred that the filament be drawn so as to attain a total effective draw ratio of at least 12 times, more preferably at least 15 times. Further, it is also possible to draw the coagulated filament by a factor of 1 to 7 through the cold drawing or wet heat drawing.

The above-described process wherein a PVA polymer having a high degree of polymerization and a degree of saponification as low as 99 mol % or less is drawn by a factor as high as at least 10 at the above-described high temperature are quite unknown to the art. The present invention enabled for the first time the formation of the above-described water-soluble PVA fiber having not only high tenacity and high modulus of elasticity but also high dissolving shrinkage ratio and high dissolving shrinkage stress.

As described above, the high-tenacity water-soluble PVA fiber of the present invention has a combination of mechanical properties favorably comparable to those of the aramid fiber, i.e., a tensile strength of at least 10 g/d and an initial modulus of at least 100 g/d, with a water soluble temperature of 100° C. or below. At the same time, the high-tenacity water-soluble PVA fiber of the present invention also has high shrinkage characteristics of a maximum dissolving shrinkage ratio of at least 60% and a maximum shrinkage stress of at least 300 mg/d. Therefore, the high-tenacity water-soluble PVA fiber of the present invention can be applied to not only applications where substantially no conventional water-soluble PVA fibers could be applied, such as underwater-disintegrable high-tenacity fiber materials, high-tenacity ropes, fishing nets, snells, and fishing guts, but also other industrial applications, such as binders for high-tenacity synthetic paper, geotextile, and sheets for civil engineering. Further, it is also possible to find industrial applications through the utilization of the high shrinkage such as shrinkable binding cords and root winding materials for vegetables.

EXAMPLE 1

A PVA having a degree of saponification of 95 mol % and a degree of polymerization of 2500 was dissolved in DMSO to prepare a spinning solution having a polymer concentration of 20 wt %. Prior to dissolution of PVA, p-toluene sulfonic acid was added to DMSO to adjust the pH value (25° C.) of the spinning solution to 6.4.

The spinning solution thus prepared was extruded, while maintaining the temperature at 100° C., into the air through a spinneret provided with 500 holes each having a diameter of 0.08 mm at a rate of extrusion of 150 cc/min. The extrudate was travelled by a distance of 10 mm in the space portion between the face of the spinneret and the liquid level of the coagulating bath and then introduced into a coagulating bath of methanol maintained at 15° C. and containing 2 wt % of DMSO. The coagulated filaments were taken up at a rate of 10 m/min. The residence time of the coagulated filaments in the coagulating bath was 15 sec.

The undrawn filaments thus prepared were washed with methanol, cold-drawn by a factor of 4 with a twin roller, passed through a lubricant bath prepared by dissolving 1 wt % of a silicone lubricant (TE-1002; a product of Toray Silicone Inc.) in methanol, and dried at 60° C. by means of a hot roller. The dried filaments were passed through a hot tube of 220° C. containing a nitrogen stream to draw them by a factor of 4.5 and then taken up with a winder. The total effective draw ratio of the resultant drawn filaments was 18.0 times, and no mutual sticking among filaments was observed. The drawn filament had a single filament fineness of 3.3 d, a tensile strength of 16.5 g/d, an elongation of 8.0%, an initial modulus of elasticity of 230 g/d, a knot strength of 5.3 g/d, a water soluble temperature of 52° C., a maximum dissolving shrinkage ratio of 80%, and a maximum dissolving shrinkage stress of 560 mg/d. Further, a cross-section of the filament was round and a small-angle X-ray scattering pattern of it was FP.

EXAMPLES 2, 3 AND 4 AND COMPARATIVE EXAMPLE 1

The 4-fold cold-drawn filament prepared in Example 1 as an intermediate filament was passed through a hot tube containing a nitrogen stream of 220° C., where the filament was drawn so as to attain a total effective draw ratio of 7 (Comparative Example 1), 12 (Example 2), 16 (Example 3), and 19 (Example 4) times. With respect to the resultant filaments, the tensile strength, initial modulus, maximum dissolving shrinkage ratio, and maximum dissolving shrinkage stress were determined. The results are shown in Table 1. These filaments exhibited a water soluble temperature ranging from 50 to 52° C., i.e., exhibited no significant difference in the water soluble temperature.

TABLE 1

| | Comp. Ex. 1 | Ex. 2 | Ex. 3 | Ex. 4 |
|---|---|---|---|---|
| total effective draw ratio (times) | 7 | 12 | 16 | 19 |
| tensile strength (g/d) | 7.8 | 12.5 | 15.3 | 17.2 |
| initial modulus (g/d) | 83 | 180 | 233 | 242 |
| shrinkage (%) | 35 | 65 | 76 | 82 |
| shrinkage stress (mg/d) | 211 | 328 | 403 | 573 |
| small-angle X-ray scattering pattern | — | FP | FP | FP |

COMPARATIVE EXAMPLE 2

Filaments were prepared in the same manner as that of Example 1, except that a spinning solution was prepared so that the concentration of PVA having a degree of saponification of 95 mole % and a degree of polymerization of 800 was 25 wt %. The drawability of the undrawn filaments was inferior to that attained in Example 1, and the total effective draw ratio was as low as 9 times. The resultant fiber had a single filament fineness of 8.0 d, a tensile strength of 5.5 g/d, an elongation of 20.1%, an initial modulus of 92 g/d, a knot strength of 2.1 g/d, a water soluble temperature of 56° C., a maximum dissolving shrinkage ratio of 33%, and a maximum dissolving shrinkage stress of 252 mg/d.

EXAMPLE 5 AND COMPARATIVE EXAMPLE 3

Four-fold cold-drawn intermediate filaments were prepared in the same manner as that of Example 1, except that a PVA having a degree of saponification of 88 mole % and a degree of polymerization of 3300 was dissolved in DMSO to prepare a spinning solution having a polymer concentration of 18 wt %. The cold-drawn filaments thus prepared were passed through a hot tube containing a nitrogen stream of 195° C. to draw them by a factor of 3.8 and then taken up with a winder. The drawn filaments had a single filament fineness of 3.5 d, a tensile strength of 13.1 g/d, an initial modulus of 152 g/d, an elongation of 10.2%, a water soluble temperature of 20° C., a maximum dissolving shrinkage ratio of 78%, and a maximum dissolving shrinkage stress of 380 mg/d. A cross-section of the filament was round and the small-angle X-ray scattering pattern of it was FP.

Further, in the present Example, the spinning was conducted with a residence time of the coagulated filaments in the coagulating bath changed to 2 sec. As a result, there occurred severe sticking among filaments, which makes it impossible to measure the properties of the single filament.

EXAMPLE 6

A PVA having a degree of saponification of 96 mole % and a degree of polymerization of 4000 was dissolved in glycerin at 160° C. to prepare a spinning solution having a polymer concentration of 15 wt %.

The spinning solution thus prepared was extruded, while maintaining the temperature at 170° C., into the air through a spinneret having 100 holes each having a diameter of 0.10 mm at a rate of extrusion of 45 cc/min. The extrudate was travelled by a distance of 20 mm in the space portion between the face of the spinneret and the liquid level of the cooling bath, introduced into a cooling bath comprising decalin of 5° C. to allow it to gel and taken up at a rate of 10 m/min. In this case, the residence time of the gelled filaments in the cooling bath was 20 sec.

The gelled filaments thus prepared were subjected to extraction of glycerin in a washing bath comprising methanol of 20° C., cold-drawn by a factor of 4 with a twin roller, passed through a lubricant bath prepared by dissolving 1 wt % of silicone lubricant (TE-1002; a product of Toray Silicone Inc.) in methanol, and dried with a hot roller of 50° C. The dried filaments were passed through a hot tube containing a nitrogen stream of 225° C. to draw them by a factor of 4.1 and taken up with a winder. The total effective draw ratio of the resultant drawn filaments was 16.4 times, and no mutual sticking occurred among single filaments. The drawn filaments had a single filament fineness of 4.5 d, a tensile strength of 18.6 g/d, an elongation of 7.8%, an initial modulus of 262 g/d, a knot strength of 5.8 g/d, a water soluble temperature of 61° C., a maximum dissolving shrinkage ratio of 81%, and a maximum dissolving shrinkage stress of 573 mg/d. The small-angle X-ray scattering pattern of the filaments was FP.

EXAMPLE 7 AND COMPARATIVE EXAMPLE 4

Spinning and drawing were conducted in substantially the same manner as that of Example 1, except that the number of the holes of the spinneret and the rate of extrusion were changed to 50 and 23 cc/min, respectively, thereby preparing drawn filaments having a multifilament fineness of $252^D$. The fiber thus prepared had a maximum dissolving shrinkage stress of 562 mg/d. Further, the small-angle X-ray scattering of the fiber was FP.

Separately, spinning and drawing were conducted in the same manner as that of Example 1, except that the number of holes of the spinneret, the rate of extrusion and the total effective draw ratio were 50, 10 cc/min and 8 times, respectively, thereby preparing drawn filaments having a multifilament fineness of $255^D$, a water soluble temperature of 48° C., a maximum dissolving shrinkage ratio of 38%, and a maximum dissolving shrinkage stress of 205 mg/d.

Each yarn thus prepared was twisted together with a polyester filament (multifilament yarn fineness: $980^D$) to attain a number of twists of 80, and the twisting was then set with hot water of 90° C. The PVA fiber thus prepared was shrinked and dissolved in boiling water to prepare a raw yarn for a crepe woven fabric. The creping effect is shown in Table 2.

TABLE 2

| | Ex. 7 | Comp. Ex. 4 |
|---|---|---|
| total effective draw ratio (times) | 18 | 8 |
| number of twists after twist setting | 9 | 24 |
| number of twists after boiling water treatment | 49 | 38 |
| creping effect | large | small |

EXAMPLE 8

A PVA having a degree of saponification of 98 mol % and a degree of polymerization of 2600 was spun and subjected to intermediate drawing in the same manner as that of Example 1 to prepare 4-fold cold-drawn filaments. The cold-drawn filaments thus prepared were passed through a hot tube containing a nitrogen stream of 220° C. to draw them by a factor of 4.8 and then taken up with a winder.

The resultant drawn filaments had a single filament fineness of 2.6 d, a tensile strength of 20.0 g/d, an initial modulus of 260 g/d, an elongation of 8.5%, a knot strength of 5.2 g/d, a water soluble temperature of 70° C., a maximum dissolving shrinkage ratio of 77%, and a maximum shrinkage stress of 581 mg/d.

COMPARATIVE EXAMPLE 5

A PVA having a degree of saponification of 97 mole % and a degree of polymerization of 1200 was dissolved in water to attain a polymer concentration of 35 wt % and then spun by the known dry spinning process. The resultant undrawn filaments were passed through a hot tube containing a nitrogen stream of 200° C. The drawability was so poor that the total effective draw ratio was as low as 6.5 times.

The drawn filaments had a single filament fineness of 2.2 d, a tensile strength of 3.5 g/d, an initial modulus of 58 g/d, an elongation of 15%, a knot strength of 2.1 g/d, a water soluble temperature of 62° C., a maximum dissolving shrinkage ratio of 35%, and a maximum dissolving shrinkage stress of 250 mg/d. Further, a cross-section of the filament was a cocoon-shape and the small-angle X-ray scattering pattern of the filament was DA.

COMPARATIVE EXAMPLE 6

A PVA having a degree of saponification of 99.9 mol % and a degree of polymerization of 2600 was spun and subjected to intermediate drawing in the same manner as that of Example 1 to prepare 4-fold cold-drawn filaments. The cold-drawn filaments thus prepared were passed through a hot tube containing a nitrogen stream of 235° C. to draw them to a draw ratio of 5.0 times and then taken up with a winder.

The resultant drawn filaments had a single filament fineness of 2.5 d, a tensile strength of 21.5 g/d, and an initial modulus of 305 g/d. Although the measurement of the water soluble temperature was attempted, the filaments was not melt-broken even in boiling water (100° C.).

EXAMPLE 9

Figure 5:
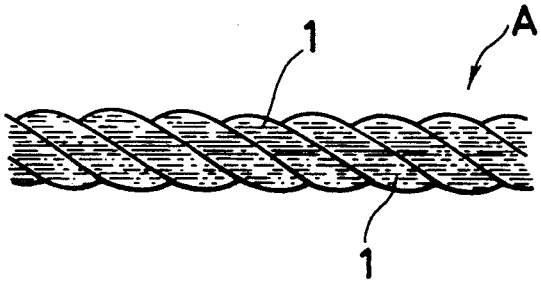
FIG. 5 is a side view of a rope structure of the present invention obtained in Example 9.

As shown in FIG. 5, 10 drawn filaments 1 prepared in Example 1 were doubled and formed into a rope structure A with three strand structures 1100/10/3 having a twist multiplier of 1500 and a diameter of 3.1 mm. The rope structure was repeatedly pulled by applying a load of 50% of the breaking stress thereto to determine the frequency of application of the load required for causing breaking of the rope (cyclic fatigue). Further, the rope structure was immersed in water of 25° C. (in a completely loosened state) to determine a time required for decreasing the tenacity of the rope structure to less than 50% of the original tenacity (tenacity-in-water dropping time).

As a result, it was found that the cyclic fatigue and the tenacity-in-water dropping time were 35,262 times and 21 hr, respectively.

We claim:

1. A high-tenacity, water-soluble fiber consisting essentially of a polyvinyl alcohol polymer with a degree of polymerization of at least 1500 and a degree of saponification of 80 to 99 mol %; said fiber having a tensile strength of at least 10 g/d, an initial modulus of at least 100 d/d, and a water soluble temperature of 100° C. or below, a maximum dissolving shrinkage ratio of at least 60%, a maximum dissolving shrinkage stress of at least 300 mg/d, and a four point axial texture structure pattern on small-angle X-ray scattering.

2. A high-tenacity water-soluble polyvinyl alcohol fiber according to claim 1, wherein said polyvinyl alcohol polymer has a degree of polymerization of at least 2000 and a degree of saponification of 87 to 97 mol % and said fiber has a tensile strength of at least 12 g/d, an initial modulus of at lest 200 g/d, and a water soluble temperature of 70° C. or below.

3. A high-tenacity watersoluble polyvinyl alcohol fiber according to claim 2, wherein said polyvinyl alcohol polymer has a degree of polymerization of at least 2500.

4. A high-tenacity water-soluble polyvinyl alcohol fiber according to claim 1, which has a maximum dissolving shrinkage ratio of at least 75% and a maximum dissolving shrinkage stress of at least 500 mg/d.

5. A high-tenacity water-soluble polyvinyl alcohol fiber according to claim 1, wherein said fiber has a round cross section.

* * * * *